US005863115A

United States Patent [19]

Simon

[11] Patent Number: 5,863,115

[45] Date of Patent: Jan. 26, 1999

[54] DECORATIVE ILLUMINATION SYSTEM

[76] Inventor: Jerome H. Simon, 17 Suffolk Rd., Chestnut Hill, Mass. 02167

[21] Appl. No.: 621,308

[22] Filed: Mar. 25, 1996

Related U.S. Application Data

[63] Continuation of Ser. No. 237,555, May 3, 1994, abandoned.

[51] Int. Cl.[6] ..... F21V 5/02

[52] U.S. Cl. ..... 362/332; 362/336; 362/337; 362/338; 362/340; 362/404; 362/806

[58] Field of Search ..... 362/326, 332, 362/336, 337, 338, 339, 340, 217, 224, 223, 806, 405, 404

[56] References Cited

U.S. PATENT DOCUMENTS

| | | | |
|---|---|---|---|
| 182,668 | 7/1876 | Hobbs | 362/340 |
| 967,029 | 8/1910 | Mygatt | 362/339 |
| 1,042,463 | 10/1912 | Mygatt | 362/340 |
| 1,894,583 | 1/1933 | Ferree et al. | 362/404 X |
| 4,118,763 | 10/1978 | Osteen | 362/339 |
| 4,459,643 | 7/1984 | Mori | 362/224 X |
| 4,575,786 | 3/1986 | Roberts | 362/281 X |
| 4,858,091 | 8/1989 | Fouke | 362/337 X |
| 5,095,415 | 3/1992 | Anderson | 362/337 X |
| 5,317,493 | 5/1994 | Muller et al. | 362/404 X |

*Primary Examiner*—Thomas M. Sember
*Attorney, Agent, or Firm*—Harvey Kaye; Jerry Cohen

[57] ABSTRACT

Illumination system with a light source and a surrounding cylindrical array of refracting elements producing spokes.

9 Claims, 4 Drawing Sheets

DECORATIVE ILLUMINATION SYSTEM

REFERENCE TO RELATED APPLICATIONS

This application is a continuation of Ser. No. 08/237,555 filed May 3, 1994, now abandoned.

FIELD AND BACKGROUND OF THE INVENTION

The present invention relates to decorative illumination.

The lighting industry could benefit from effective systems that would contribute architectural/decorative values in original and rehab' constructions and in redecoration of interior and exterior spaces.

SUMMARY OF THE INVENTION

A ligting product which can be mounted to an architectural surface such as a wall or column (such an a aconce) or be suspended as a pendant which provides a decorative pattern in the form of radiant spoke of light which act as direct or indirect illumination. This device provides useful illumination and at the same time provides decoration which may substitute for painted or wallpapered decoration.

It 1s an object of the present invention to provide an efficient means for decorative ligeting whereby a decorative pattern is ormed by a series of rays from a light source where substantially all the radiant flux of the source is used for illumination. Brieiy stated, in accordance with the present invention, a cylindrical body surrounds a light source and is comprised of a series of adjacent, axially extending retracting elements. The cross-section of the cylinder tray comprise a curve polyhedron or irregular shape.

DESCRIPTION OF THE DRAWINGS

The means by which the foregoing objects and features of the invention are achieved are pointed out in the claims forming the concluding portion of the specification. The invention, both as to its organization and manner of operation, may further be understood by reference to the following description taken in connection with the following drawings.

Shows an isometric cutaway view of a quasi point source within a cylinder comprised of prism refractors. The quasi point source is located in an axial position so that a large portion of the flux is directed toward an adjacent surface.

FIG. 1A

Figure 1:
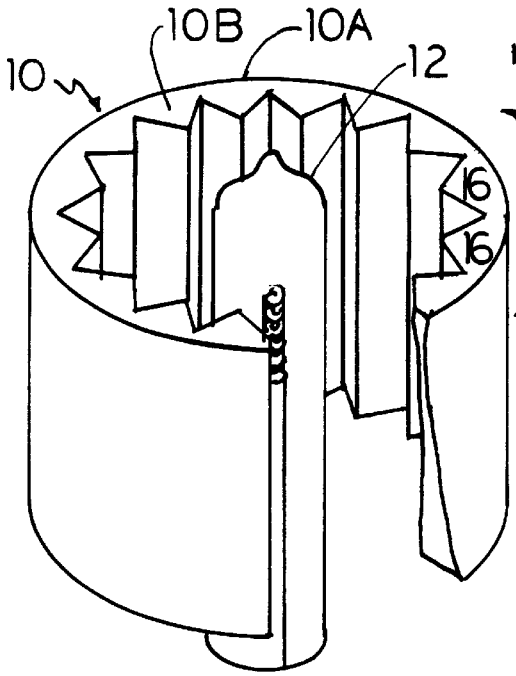
FIG. 1

Shows the type of spoke pattern produced by what is shown in FIG. 1.

FIG. 2 shows an isometric cutaway view of a quasi point source within a cylinder comprised of convex cylinder lenses.

FIG. 2A

Figure 2:
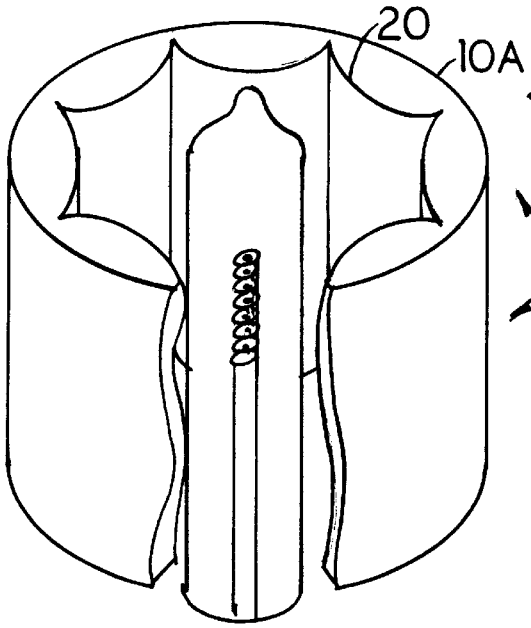

Shows the type of spoke pattern that is shown in FIG. 2.

FIG. 3

Shows an isometric cutaway view of a quasi point source within a cylinder comprised of concave cylinder lenses.

FIG. 3A

Figure 3:
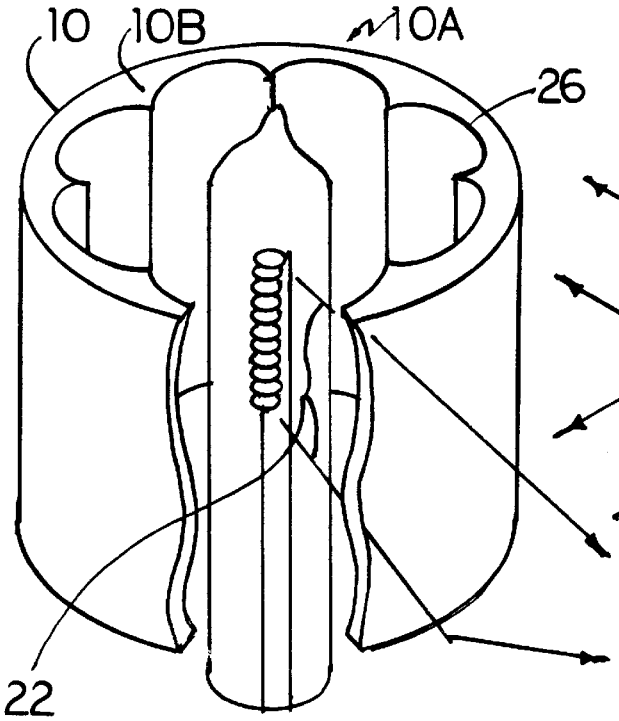

Shows the type of spoke pattern that is shown in FIG. 3.

FIG. 4

Shows an isometric cutaway view of a quasi point source within a cylinder comprised of a mix of prisms, convex cylndrical lenses and concave cylindrical lense.

FIG. 4A

Figure 4:
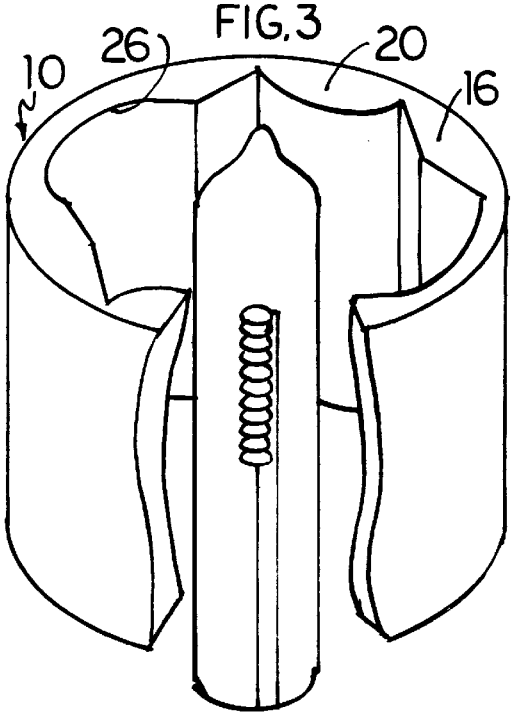

Shows the type of spoke pattern that is shown in FIG. 4.

FIG. 5

Shows an isometric view of a quasi point source within a cylinder comprised of faces of flat outside contours forming a polyhedra.

FIG. 6

Shows an isometric view of a quasi point source surrounded by a polyhedra comprised of differing refracting device with varied outside contours. Also shown is that various sections containing differig outside contours and refracting devices are interchangeable.

FIG. 7

Shows an isometric view of a quasi point source surrounded by a cylinder comprised of prisms with a supported surface to receive the spokes of light.

FIG. 8

Shows an isometric cutaway view of a quasi point source surrounded by a cylinder comprised of positive cylinder lens with the outer surface contoured in the form as a convex refractive ring. Also shown to a cross section of the light within the spoke beng focused on an adjacent surface.

DETAILED DESCRIPTION OF PREFERRED EMBODIMENTS

Figure 1A:
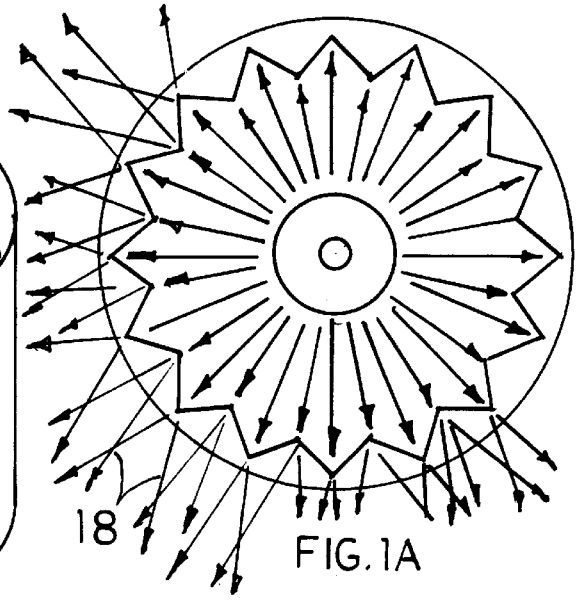

Referring now to the drawings there is shown an illumination system 10 comprising an axially elongated light source 12, such as an incandescent lamp (quartz/halogen), surrounded by a cylindrical array of refractive elements of, typically, 60–90 degree prisms (in the FIG. 1–1A case, 90 degrees). Spoke rays of light 18 (FIG. 1A) emerge from the system in a cross-hatched pattern including portions of the spokes that are angularly offset from radial by 1 to 89 degrees (plus or minus) typically 22.5 to 60 degrees.

Figure 2A:
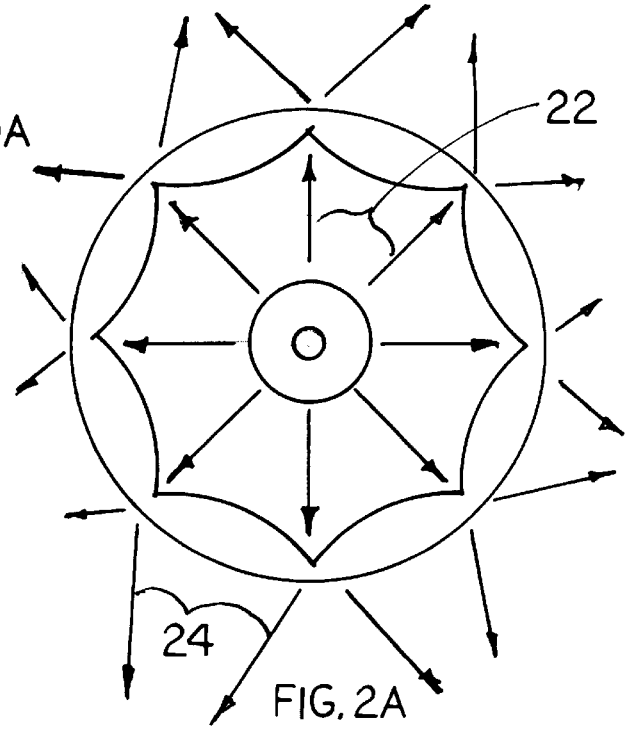

FIGS. 2 and 2A show a variant of the embodiment of FIGS. 1 and 1A. In FIGS. 2–2A prism surface 16 of FIGS. 1–1A has been replaced by convex surface 20 forming a positive cylindrical lens with surface 10A. This cylindrical lens focuses the radiating light 22 from the source 12 into substantially triangular shaped radial beam 24.

Figure 3A:
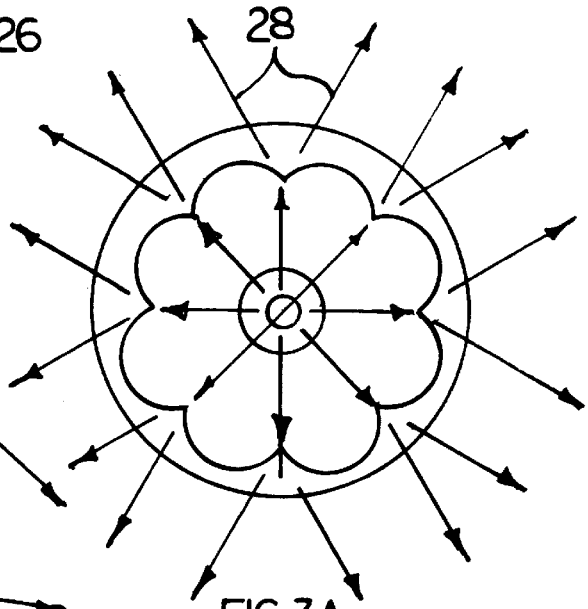

FIGS. 3 and 3A show a further variant Surface 20 (FIG. 2) is a concave surface 26 forming a negative cylinder lens with surface 10A; this results in the radiating light 22 from source 12 leaving surface 10A at an increased angle of divergence to form bright, overlapping light spokes 28. FIG. 3 also shows that by placing source 12 towards the top of the cylinder 10B, radiating light 22 is further directed to an adjacent architectural surface (e.g. floor, wall, surface, ceiling, divider panel, etc.)

Figure 4A:
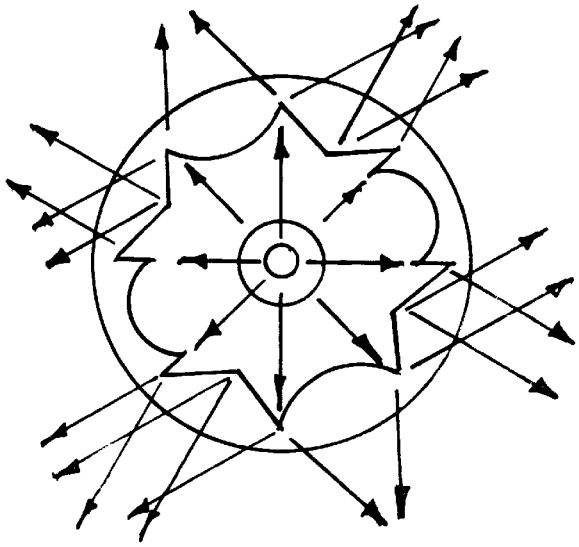

FIGS. 4 and 4A show a further variant in that the cylinder 10B is comprised of a combination of prisms 16, convex surface 20, concave surfaces 26. The radiant energy 22 from source 12 forms a mix of spokes 18 (FIG. 1A), 24 (FIG. 2A) and 28 (FIGS. 3A).

Figure 5:
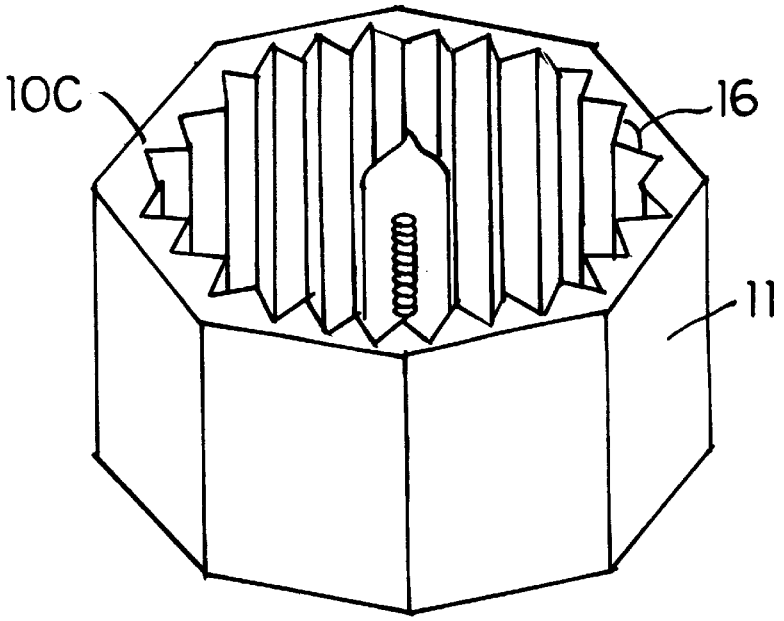

FIG. 5 shows a variant in that the cylinder 10B (FIG. 1) has been altered to be a cylindrical polyhedron 10C formed by prisms 16 and flat faces 11.

Figure 6:
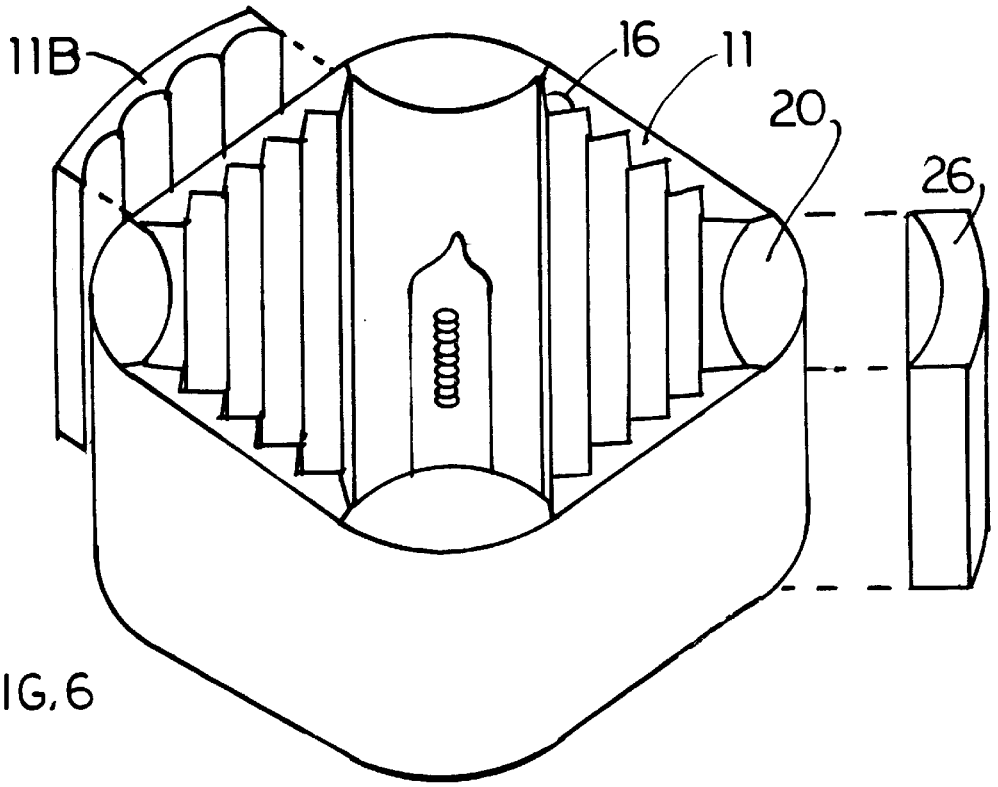

FIG. 6 shows a variant of FIG. 5 in that the polyhedron 10C is alternatively constructed of plates 11 and positive cylinders 20 and may be removed and replaced by plate 11B and convex lens 26 respectively.

Figure 7:
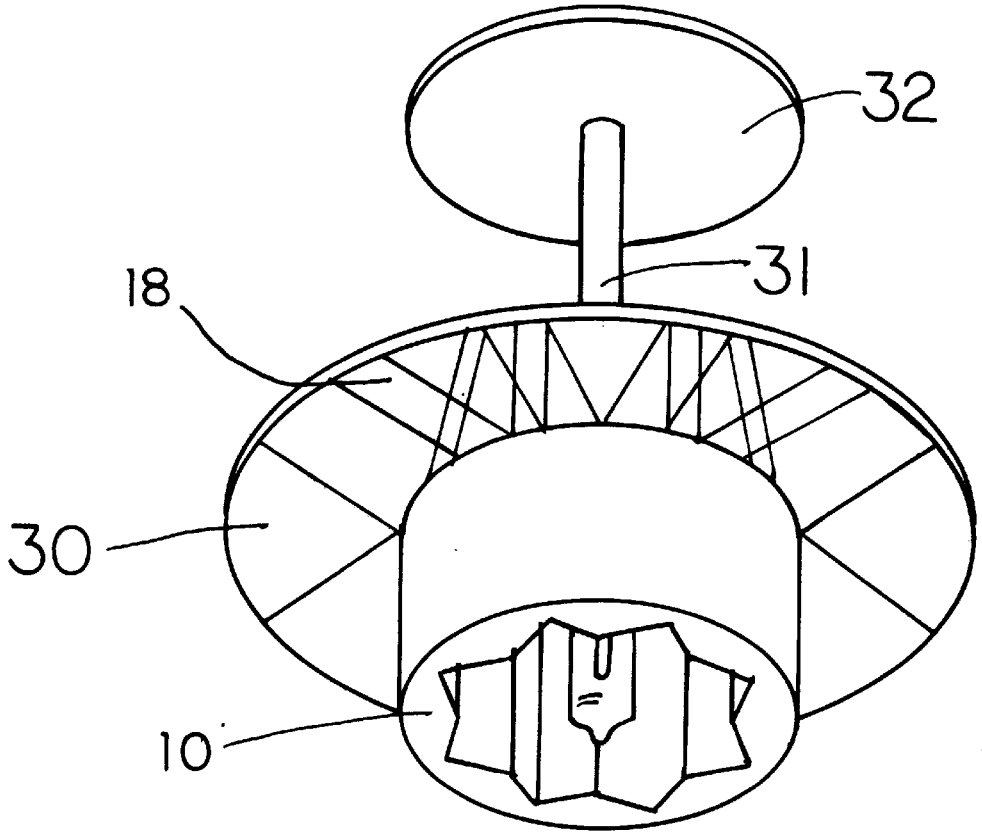

FIG. 7 shows an illumination system 10 screen attached to plate 30 that acts to receive ray spokes 18. Further this combined illuminating system 10 and plate 30 may be suspended by rod 31 and canopy 32 which are used to attach 10 to an architectural surface.

Figure 8:
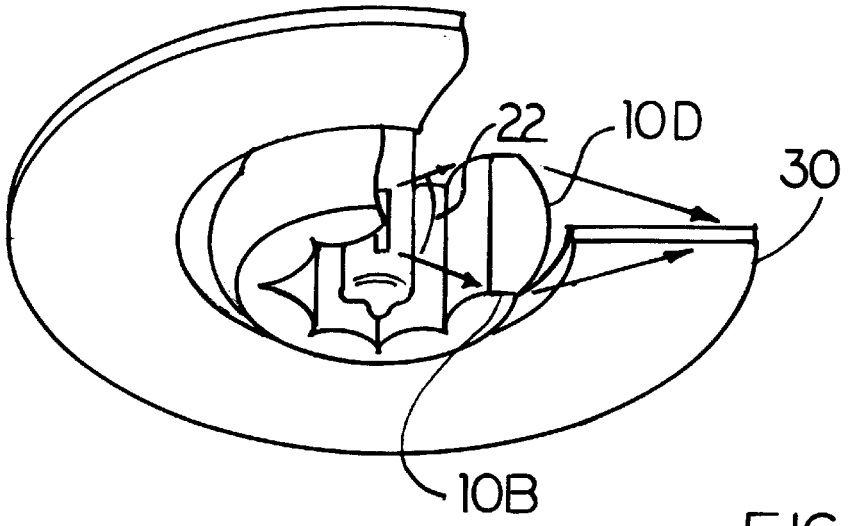

FIG. 8 shows a further variant of FIG. 7 in that outside face of cylinder 10B (FIG. 1) is formed as a convex surface 10D to focus radiant light 22 towards plate 30.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

I claim:

1. An illumination system for creating patterns of light on an adjacent surface comprising:

a quasi point light source, a surface onto which patterns of light are to be formed, and a cylindrical refracting means surrounding the source radially and disposed adjacent to the surface, said cylindrical means comprising substantially axially elongated refracting elements the refracting portions of which are on the inner surface thereof and directly facing said source for refracting light traveling from said source into elongated spokes of light extending outwardly towards the adjacent surface and creating spokes of light on such surface, said quasi point source being positioned with respect to said cylindrical means so that a substantial portion of flux from said quasi point source is refracted by said cylindrical means in a direction angularly offset from the radial direction towards the adjacent surface to produce visible patterns of light on the surface, said adjacent surface abutting against said cylindrical means.

2. The system according to claim 1 wherein said cylindrical means is formed to have a preselected polyhedral cross section.

3. The system according to claim 1 wherein said cylindrical means comprises an array of lineal prisms.

4. The system according to claim 1 wherein said cylindrical means comprises cylinder lenses.

5. The system according to claim 4 wherein said cylinder lenses have outer, convex surfaces.

6. The system according to claim 1 wherein said cylindrical means comprises a mixture of prisms, and concave and convex cylindrical lenses.

7. The system according to claim 1 wherein said cylindrical means comprises interchangeable sections, each section having a selected contour.

8. The system according to claim 1 wherein said surface comprises a plate surrounding said cylindrical means at an axial end thereof.

9. The system according to claim 1 wherein said surface comprises a plate surrounding said cylindrical means and positioned at an axial central location.

* * * * *